United States Patent [19]

Seemuth

[11] Patent Number: 4,457,763

[45] Date of Patent: Jul. 3, 1984

[54] DIESEL FUEL CETANE IMPROVER

[75] Inventor: Paul D. Seemuth, Baton Rouge, La.

[73] Assignee: Ethyl Corporation, Richmond, Va.

[21] Appl. No.: 548,928

[22] Filed: Nov. 7, 1983

[51] Int. Cl.[3] ..... C10L 1/22

[52] U.S. Cl. ..... 44/57; 44/63; 44/56; 549/372; 549/451

[58] Field of Search ..... 44/57, 53, 56, 63; 549/372, 451

[56] References Cited

U.S. PATENT DOCUMENTS 2,331,158 10/1943 Arundale et al. ..... 44/63

4,390,345 6/1983 Somorjai ..... 44/63

4,406,665 9/1983 Filbey ..... 44/57

OTHER PUBLICATIONS

Chemical Abstracts 43580t, vol. 72, 1970. pp. 450–451.

*Primary Examiner*—Charles F. Warren

*Assistant Examiner*—Margaret B. Medley

*Attorney, Agent, or Firm*—Donald L. Johnson; John F. Sieberth; Joseph D. Odenweller

[57] ABSTRACT

Cetane rating of diesel fuel is increased by adding a dioxane nitrate such as m-dioxan-5-ol nitrate and 1,3-dioxolane-4-methanol nitrate.

5 Claims, No Drawings

DIESEL FUEL CETANE IMPROVER

BACKGROUND

Diesel engines operate by compression ignition. They have compression ratios in the range of 14:1 to 17:1 or higher and for that reason obtain more useful work from a given amount of fuel compared to an Otto cycle engine. Historically, diesel engines have been operated on a petroleum-derived liquid hydrocarbon fuel boiling in the range of about 300°–750° F. Recently, because of dwindling petroleum reserves, alcohol and alcoholhydrocarbon blends have been studied for use as diesel fuel.

One major factor in diesel fuel quality is cetane number. Cetane number is related to ignition delay after the fuel is injected into the combustion chamber. If ignition delays too long, the amount of fuel in the chamber increases and upon ignition results in a rough running engine and increased smoke. A short ignition delay results in smooth engine operation and decreases smoke. Commercial petroleum diesel fuels generally have a cetane number of about 40–55. Alcohols have a much lower cetane value and require the addition of a cetane improver for successful engine operation.

Through the years, many types of additives have been used to raise the cetane number of diesel fuel. These include peroxides, nitrites, nitrates, nitrosocarbamates, and the like. Alkyl nitrates such as amyl nitrate, hexyl nitrate and mixed octyl nitrates have been used commercially with good results.

SUMMARY

It has now been discovered that the cetane rating of diesel fuel can be substantially increased by the addition of a small amount of a dioxane nitrate such as m-dioxan-5-ol nitrate and 1,3-dioxolane-4-methanol nitrate.

DESCRIPTION OF PREFERRED EMBODIMENTS

A preferred embodiment of the invention is a diesel fuel cotaining a cetane increasing amount of dioxane nitrate having the structure

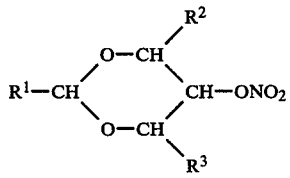

or

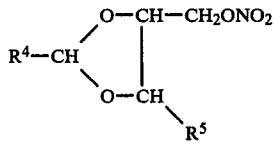

wherein $R^1$, $R^2$, $R^3$, $R^4$ and $R^5$ are independently selected from the group consisting of hydrogen and $C_{1-12}$ alkyls, and mixtures thereof.

Examples of the above dioxane nitrates are m-dioxan-5-ol nitrate; 1,3-dioxolane-4-methanol nitrate; 1,3-dioxolane-4-ethanol nitrate; 1,3-dioxolane-4-propanol nitrate, 1,3-dioxolane-4-butanol nitrate; 1,3-dioxolane-4-octanol nitrate; 1,3-dioxolane-4-dodecanol nitrate; 1,3-dioxolane-4-(2-methylpropanol)nitrate; 1,3-dioxolane-4-(2-methyl butanol)nitrate, 1,3-dioxolane-2-methyl-4-methanol nitrate, 1,3-dioxolane nitrate, 1,3-dioxolane-5-ethyl-4-methanol nitrate, 1,3-dioxolane-2-decyl-4-methanol nitrate, 1,3-dioxolane-2-dodecyl-4-methanol nitrate, m-dioxan-2-methyl-5-ol nitrate, m-dioxan-2,2-dimetyl-5-ol nitrate, m-dioxan-4-methyl-5-ol nitrate, m-dioxan-4,6-dimethyl-5-ol nitrate, m-dioxan-2-dodecyl-4-butyl-5-ol nitrate and the like.

The most preferred dioxane nitrates are m-dioxan-5-ol nitrate and 1,3-dioxolane-4-methanol nitrates and especially mixtures of these additives. The additives are made by nitrating the corresponding alcohol. Preparation of the alcohols is reported in J. Am. Chem. Soc. 50 2242 (1928). Preparation of the dioxane nitrates is reported at "Collection Czechoslov. Chem. Commun." Vol. 34, pps. 3646–3651 (1969).

The alcohols are preferably nitrated by adding them to a mixture of nitric acid and acetic anhydrate at −10° C. to 0° C. The following example illustrates the preparation of the nitrate esters. These products should be handled with caution because of their potential explosive nature.

EXAMPLE

In a reaction vessel was placed 7.26 g. nitric acid (70%) and 24.5 g. acetic anhydride. While stirring 10.0 grams of a mixture of 67±2.3 area % m-dioxan-5-ol and 33+2.2 area %'s 1,3-doxolane-4-(GC) methanol was added at about 0° to −13° C. over a 49 minute period. It was necessary to add about 5 ml. acetic anhydride at 29 minutes to prevent solidification. The reaction mixture was quenched in ice water and an organic phase separated. After separating, ether was added to extract the nitrate from the aqueous phase. All organic material was neutralized with 9% caustic. It was then water washed and dried over sodium sulfate. Ether was evaporated off under vacuum leaving 8.78 grams of a mixture of m-dioxan-5-ol nitrate and 1,3-dioxolane-4-methanol nitrate as a pale yellow oil.

The individual nitrates can be prepared following the above procedure by separating the starting material by distillation prior to nitration.

The amount of cetane improver added depends on the type of fuel being used, the initial cetane value, and the amount of cetane number increase desired. Alcohol fuels such as methanol, ethanol, isopropanol, isobutanol, hexanol, and the like, have very low cetane values and large amounts of cetane improvers are required. A useful range in which to operate is about 5–25 weight percent cetane improver.

Blends of alcohol and petroleum-derived diesel fuel have higher cetane values and require less cetane improver. A useful range is about 0.5–10 weight percent.

Petroleum-derived distillate fuels in the diesel boiling range require only small amounts of cetane improver to achieve a significant increase in cetane number. Such fuels, without any cetane improver, generally have cetane numbers in the range of about 25–60. Cetane numbers in the range of 25–35 are considered low and those in the range of 50–60 are considered top grade diesel fuels. Diesel fuels in the 35–50 mid-range are most common. An object of the invention is to upgrade the low cetane number fuels at least into the mid-range and to increase the cetane value of the mid-range fuels into the upper portion of the mid-range (e.g. 45–50) or even into the premium range above 50. It has been found that highly beneficial results can be achieved using as little as 0.05 weight percent of the present additive. Accordingly, a useful concentration range in petroleum derived diesel fuel is about 0.01–5 weight percent and more preferably about 0.05–0.5 weight percent.

The cetane response caused by the dioxane nitrates was measured using a standard cetane engine. The results were directly compared to the response obtained with a commercial octyl nitrate cetane improver. Rseults are given in the following table

| Additive | Cone (wt %) | Cetane Number |
|---|---|---|
| None | — | 37.54 |
| Isooctyl Nitrate | 0.15 | 41.79, 41.68 |
| Dioxane Nitrate | 0.15 | 42.30, 42.07 |

[1]The nitrate mixture from the example.

These results show that at the same concentration the dioxane nitrates give a substantially higher cetane increase compared to a commercial alkyl nitrate.

I claim:

1. Diesel fuel containing a cetane increasing amount of a dioxane nitrate having the structure

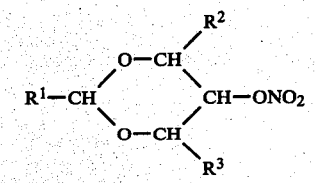

or

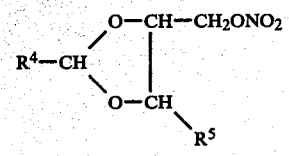

wherein $R^1$, $R^2$, $R^3$, $R^4$ and $R^5$ are independently selected from the group consisting of hydrogen and $C_{1-12}$ alkyls, and mixtures thereof.

2. A composition of claim 1 wherein said diesel fuel is a petroleum distillate fuel of the diesel boiling range.

3. A composition of claim 2 wherein said dioxane nitrate is m-dioxan-5-ol nitrate.

4. A composition of claim 2 wherein said dioxane nitrate is 1,3-dioxolane-4-methanol nitrate.

5. A composition of claim 2 wherein said dioxane nitrate is a mixture of m-dioxan-5-ol nitrate and 1,3-dioxolane-4-methanol nitrate.

* * * * *